US008002032B2

(12) United States Patent
Cenac et al.

(10) Patent No.: US 8,002,032 B2
(45) Date of Patent: Aug. 23, 2011

(54) HYDRAULIC OVERSHOT WITH REMOVABLE SETTING AND TESTING CORE

(75) Inventors: Martin Cenac, Lafayette, LA (US); Fredrick Wong, Mandeville, LA (US)

(73) Assignee: Blowout Tools, Inc., Houston, TX (US)

( * ) Notice: Subject to any disclaimer, the term of this patent is extended or adjusted under 35 U.S.C. 154(b) by 247 days.

(21) Appl. No.: 12/334,800

(22) Filed: Dec. 15, 2008

(65) Prior Publication Data

US 2009/0178810 A1 Jul. 16, 2009

Related U.S. Application Data

(60) Provisional application No. 61/013,506, filed on Dec. 13, 2007.

(51) Int. Cl.
*E21B 47/10* (2006.01)
*E21B 31/18* (2006.01)

(52) U.S. Cl. ..... 166/250.08; 166/98; 166/301; 166/387; 294/86.12; 294/86.15

(58) Field of Classification Search ..... 166/250.08, 166/387, 378, 301, 98; 294/86.12, 86.15
See application file for complete search history.

(56) References Cited

U.S. PATENT DOCUMENTS

| | | | | | |
|---|---|---|---|---|---|
| 2,394,759 | A * | 2/1946 | Edwards | 166/301 |
| 2,577,994 | A * | 12/1951 | Bendeler et al. | 166/77.51 |
| 3,378,080 | A * | 4/1968 | Fredd | 166/156 |
| 3,478,577 | A * | 11/1969 | Hauk | 73/49.1 |
| 3,500,909 | A * | 3/1970 | Beyer | 166/134 |
| 5,197,547 | A * | 3/1993 | Morgan | 166/387 |
| 5,413,171 | A * | 5/1995 | Womack | 166/98 |
| 5,474,124 | A * | 12/1995 | Samuels et al. | 166/85.1 |
| 5,580,114 | A * | 12/1996 | Palmer | 294/86.15 |
| 5,765,638 | A * | 6/1998 | Taylor | 166/98 |
| 6,056,049 | A * | 5/2000 | Davis | 166/55.7 |
| 6,059,336 | A * | 5/2000 | Meronek | 294/88 |
| 7,083,209 | B2 * | 8/2006 | Leman et al. | 294/86.17 |
| 7,617,867 | B2 * | 11/2009 | Lynde et al. | 166/98 |
| 7,631,699 | B2 * | 12/2009 | Cisneros | 166/382 |
| 2008/0029275 | A1 * | 2/2008 | Cisneros | 166/383 |
| 2008/0217014 | A1 * | 9/2008 | Lynde et al. | 166/301 |
| 2009/0178810 | A1 * | 7/2009 | Cenac et al. | 166/387 |

* cited by examiner

*Primary Examiner* — Jennifer H Gay
(74) *Attorney, Agent, or Firm* — Garvey, Smith, Nehrbass & North, L.L.C.; Gregory C. Smith; Vanessa M. D'Souza

(57) ABSTRACT

A hydraulic overshot apparatus designed to slide over plain end tubing and set by applying hydraulic fluid, under pressure, via a hydraulic setting port, into a center chamber which allows pressure to direct to two different piston areas. The setting piston compresses packer elements and tubing slips against the outer diameter (O.D.) of the tubing. The test piston compresses tubing test elements against the inner diameter (I.D.) of the tubing. The setting pressure is ported through the upper setting and test portion to allow pressure to move from the center chamber to the lower outer portion. The lower outer portion includes a body lock ring and a setting piston for setting the packer elements. Setting pressure moves the setting piston down through the body lock ring. As the setting piston moves down, it ratchets down through the body lock ring. The teeth on both the setting piston and body lock ring will prevent the backward movement (or upward movement) of the setting piston as it moves through the body lock ring.

12 Claims, 6 Drawing Sheets

HYDRAULIC OVERSHOT WITH REMOVABLE SETTING AND TESTING CORE

CROSS-REFERENCE TO RELATED APPLICATIONS

Priority of U.S. Provisional Patent Application Ser. No. 61/013,506, filed Dec. 13, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The system of the present invention relates to a tool designed to fit over the end of tubing which has been exposed by removing of the casing and wellhead, due to storm damage. More particularly, the present invention relates to a hydraulic overshot tool having a removable setting and testing core designed to fit over the end of the tubing which has been exposed by removal of the casing and wellhead due to storm damage wherein the production platform and wellhead was laid over or down from high seas and wind forces that were generated by the storm.

2. General Background of the Invention

In the event of a storm or other catastrophe to a production rig in, for example, the Gulf of Mexico, oftentimes the very fierce winds and large wave action will damage the production platform and the wellhead will be laid over and the production tubing has been exposed by storm damage or ship/barge collision damage to the production platform structure and production systems. As the damaged structure and equipment is removed, the original wellhead is removed which leaves an open ended production tubing and production casing. Only the Surface Controlled Subsurface Safety Valve or SCSSV prevent wellbore fluid from flowing out of the tubing. Therefore, there is a need in the industry for the installation of a device, such as the present invention, referred to as the hydraulic overshot with removable setting and testing core, which can be installed onto the plain tubing end, and would allow for the use of industry standard well control service equipment such as a wireline blowout preventer stack, a coil tubing blowout preventer stack, or a temporary master valve to be connected to the tool and seal the tubing.

BRIEF SUMMARY OF THE INVENTION

The apparatus of the present invention solves the problems in the art in a simple and straightforward manner. What is provided is a device referred to as hydraulic overshot tool with removable setting and testing core. The lower section of the tool includes a pack off mechanism, which further includes slips, packer element, lock mechanism, and release mechanism for engaging onto the end of the tubing. After the lower section is in place on the tubing, the upper section of the tool includes the setting and testing mechanism designed to direct hydraulic pressure to a first piston area used to compress the packer elements, slips, and the lock mechanism; and the second piston area used to compress the tubing pack off elements. In the first piston area, the piston section of the locking mechanism moves down while the body-lock ring stays in a fixed position. The lock piston's downward movement compresses the packer elements against a slip cone. The reaction forces will cause the slip cone to move the slips down against release nut which contents a reverse facing slip cone. The next reaction will force the slips down the tubing which prevents the tool from moving on the tubing. The compressed packer elements provide a seal between the outer body of the tool and the tubing. In the second piston area, the piston moves down and force a non extrusion ring or gage ring to move down. The non extrusion ring compresses the tubing pack off elements against a nut or stationary gage ring. The compressed tubing pack off elements will bear against the tubing wall I.D. and the core of the setting mechanism. This will create a tubing seal which plug the I.D. of the tubing. With the tubing plug in place, pressure can be applied through a test port to insure that the packer element have made a good seal.

After the hydraulic overshot tool has been pressure tested, the hydraulic test pressure and setting pressure is released, which allows the removal of the top section of the tool and the I.D. tubing plug. With the top section removed, the operator tool has a bore maximum bore that is equal to the tubing I.D. The connection at the top of the tool has an industry standard Bowen Union which allows a variety of support equipment to be attached, including but not limited to (1) Wireline Blowout Preventer Stack; (2) Work Over Blowout Preventer Stack; (3) Master Valve; (4) Temporary Well Control Stack; (5) Coil Tubing Blowout Prevent Stack and Injection Head; and (6) Device to pull tubing from the well.

It is a principal object of the present invention to provide a hydraulically operated overshot apparatus which hydraulically sets and seals the apparatus to both the inner and outer walls of the tubing, and allows a fluid test to test the integrity of the seals so that when the removable upper portion of the device is removed, the lower portion remains sealed around the outer wall of the tubing to accommodate testing and workover tools thereupon.

It is a further principal object of the present invention to provide a hydraulic overshot apparatus having an upper setting and testing portion which is removable from the lower portion after the lower portion is sealed onto the outer wall of the tubing and the integrity of the seal has been confirmed.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
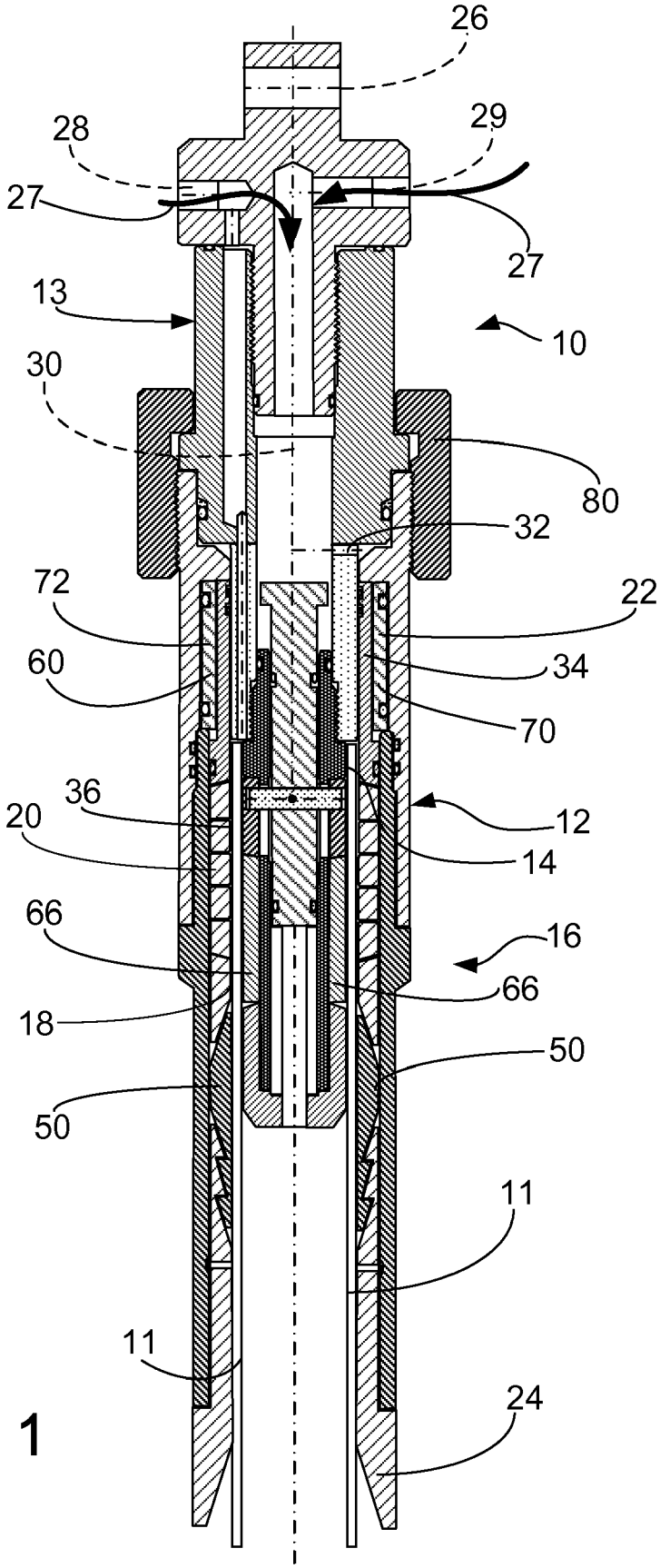
FIG. 1 is a cross-section view of the preferred embodiment of the hydraulic overshot apparatus with removable setting and testing core of the present invention.

FIGS. 1 through 6 describes the operation of the hydraulic overshot apparatus with removable setting and testing core 10, or hydraulic overshot apparatus 10, for short. Hydraulic overshot apparatus 10 is designed to be installed on API specification tubing 11 which has been exposed by storm damage or ship/barge collision damage to the production platform structure and production systems. As the damage structure and equipment is removed, the original wellhead is removed which leaves an open ended production tubing 11 and production casing. Only the Surface Controlled Subsurface Safety Valve or SCSSV prevents wellbore fluid from flowing out of the tubing 11. The installation of the hydraulic overshot apparatus 10 on the upper end of the plain tubing 11 allows the installation and use of industry standard well control service equipment, such as a wireline blowout preventer stack, a coil tubing blowout preventer stack, or a temporary master valve.

The hydraulic overshot apparatus 10 is designed to slide over plain end tubing 11. Once, the apparatus 10 is installed correctly of the tubing 11, the apparatus 10 is set by applying hydraulic fluid 27, under pressure, through the hydraulic setting port 29, as will be described further. The setting pressure is pumped into a center chamber 30 which allows pressure to direct to two different piston areas, 34 and 60. The outer chamber or setting piston 34 compresses the packer elements 36 and tubing slips 50 against the outer diameter (O.D.) of tubing 11. The inner chamber or test piston 60 compresses the tubing test elements 66 against the inner diameter (I.D.) of tubing 11. The setting pressure is ported through the upper setting and test portion 13 of apparatus 10 to allow pressure to move from the center chamber 30 to the lower outer portion 12.

The lower outer portion 12 includes a body lock ring 70 and a setting piston 34 for setting the packer elements 36. Setting pressure moves the setting piston 34 down through the body lock ring 70. As the setting piston 34 moves down, it ratchets down through the body lock ring 70. The teeth 72 on both the setting piston 34 and body lock ring 70 will prevent the backward movement (or upward movement) of the setting piston 34 as it moves through the body lock ring 70.

The downward movement of the setting piston 34 will compress the packer elements 36 and force the tubing slips 50 down onto the O.D. of the tubing 11. The setting force is stored in the packer elements 36 and provides reaction force needed to prevent movement of the tubing 11. After the apparatus 10 has been set and tested, the setting and testing core portion 13 is removed to allow work over operations. If tubing or work over pumping pressure is allowed to come up through the apparatus 10, the pressure will increase the setting pressure on the tubing slips 50.

In discussing the use of the hydraulic overshot apparatus 10 as disclosed herein in FIGS. 1 through 6 and explained above, the first thing to consider is that the casing and the tubing 11 has been exposed. In order to be placed on the tubing 11, the apparatus 10 is capable of grabbing hold of at least six inches of the tubing 11 which is exposed, but will need at least twelve inches of tubing 11 to be inserted into the tubing 11. The tubing 11 would be latched onto a subsurface packer. There would be provided a safety valve downhole (not illustrated), which would include a seal assembly latched into a packer, and the safety valve would be closed so as to prevent whatever amount of fluid pressure within the tubing below the safety valve to flow out of the upper end of the tubing 11. At this point, the well head is gone, and there is no way of reopening the valve, no way to control the flow. Therefore one would utilize the hydraulic overshot with removable setting and testing core apparatus 10 to secure to the upper end of the tubing 11 before the safety valve is open to release the pressure within the tubing 11.

As illustrated, the overshot apparatus 10 comprises a first lower section 12 which would be resting on the upper end 14 of the tubing 11. This lower section 12 would comprise a packer or pack off mechanism 16, which further includes slips 18, packer elements 20, lock mechanism or ring 22, and release mechanism or nut 24 for sealingly engaging onto the end of the tubing 11, as will be discussed in greater detail. The upper portion of the apparatus 10 would be the lower removable setting and testing core portion 13 which is illustrated in FIG. 1 as set upon lower portion 12.

Figure 2:
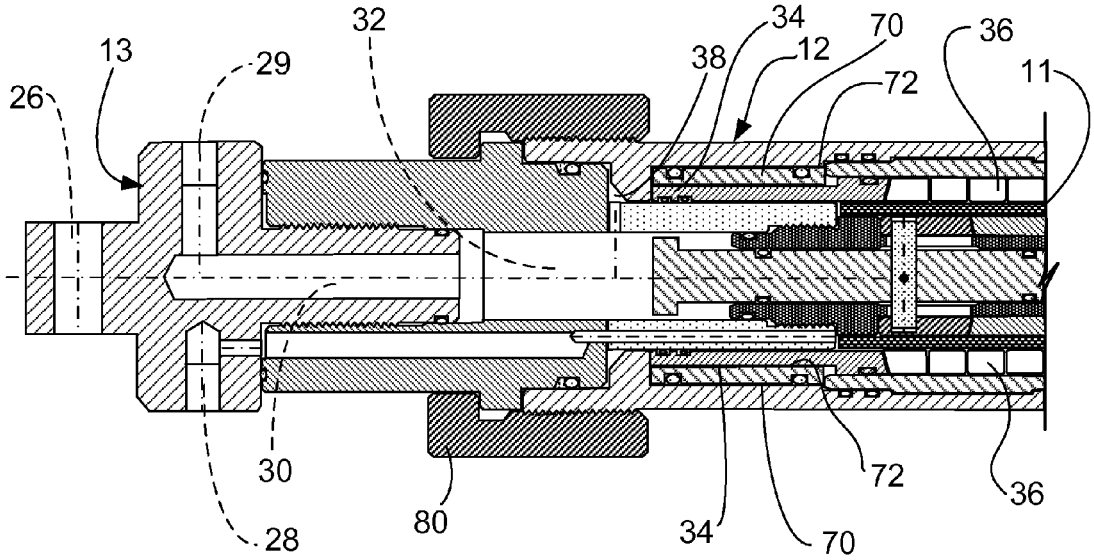
FIG. 2 is an isolated cross-section view of the upper portion of the hydraulic overshot apparatus with removable setting and testing core of the present invention, illustrating the setting piston in the upper position.
Figure 3:
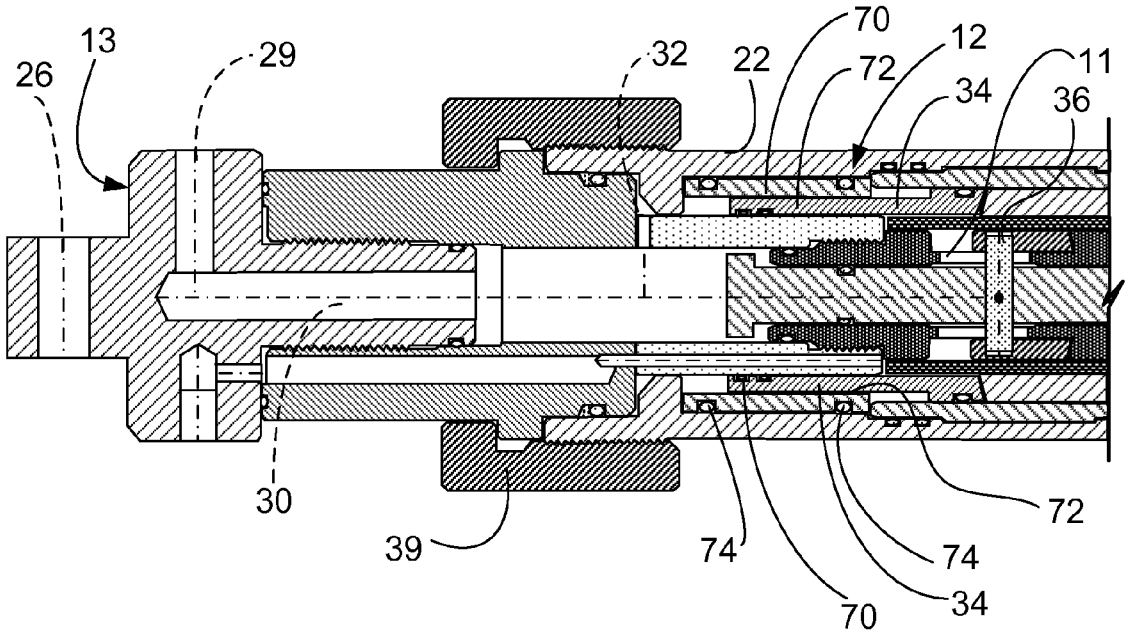
FIG. 3 is an isolated cross section view of the hydraulic overshot apparatus with removable setting and testing core of the present invention, illustrating the setting piston in the lower position, which compresses the packer elements against the O.D. of the tubing.
Figure 4:
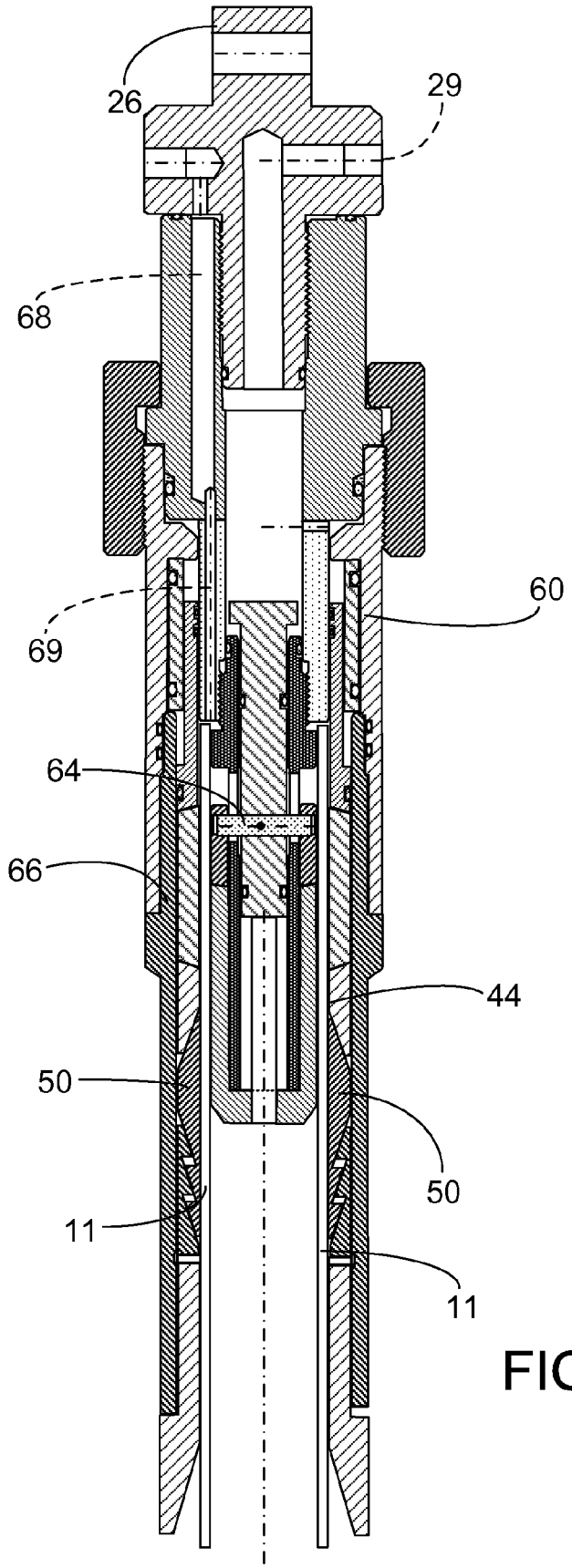
FIG. 4 is a cross-section view of the hydraulic overshot apparatus with removable setting and test core, illustrating the setting piston moving and compressing test elements to seal the I.D. of the tubing.

As illustrated in the drawing Figures, and especially in FIG. 1, and in isolated views in FIGS. 2 and 3, there is provided a length of tubing 11, with the upper end 14 of tubing 11 provided with the hydraulic overshot apparatus 10 engaged thereupon . The apparatus 10 could be lifted via a crane or the like, via the lifting eye 26. A fluid 27 would be introduced into the hydraulic setting port 29 in the removable setting and testing core portion 13, under a predetermined pressure, and the fluid 27 would travel down the center port 30 within the removable setting and testing core portion 13 and flow into port 32, forcing the downward movement of the setting piston 34, which would force the packing elements 36 by setting piston 34, by going down the center port 30 and into port 32 and pushes setting piston 34; setting piston 24 is pushed down for packer elements 36. Simultaneously, seen in FIG. 3, the fluid 27 also flows into flow port 32, which forces piston 34 in a downward direction, which presses the packer elements 36. As seen in FIG. 4, the fluid 27 also pushes the cone 44 in the down direction, forcing cone 44 to push the tubing slips 50 to grab the tubing 11. The packing elements 36 seal the fluid flow between the tubing and the lower portion 12 of the apparatus 10, as the tubing slips 50 lock on to the other wall of the tubing 11.

At the same time, the fluid 27 forces piston 60, as seen in FIG. 4, down onto the T-bar 64 which in turn compresses another set of packing test elements 66. These elements 66, which are flexible and rubberized material, when compressed, will seal the I.D. of the tubing 11. At this point in the process, O.D. of the tubing 11 is sealed against fluid pressure as is the I.D. of the tubing 11. The hose is disconnected from the disconnect from the hydraulic setting port 29 and moved to the hydraulic test port 26, and the apparatus 10 is pressured up to 5000 pounds. The fluid 27 will travel on the outside of the tubing 11 and the inside of tubing 11, as it travels down the upper test port 68 and enters the lower test port 69, as seen in FIG. 1. At this point the fluid pressure is testing the tubing packer elements 36, while also testing the seal of the test elements 66; that is both outer and inner seals are being tested at the same time.

Figure 5:
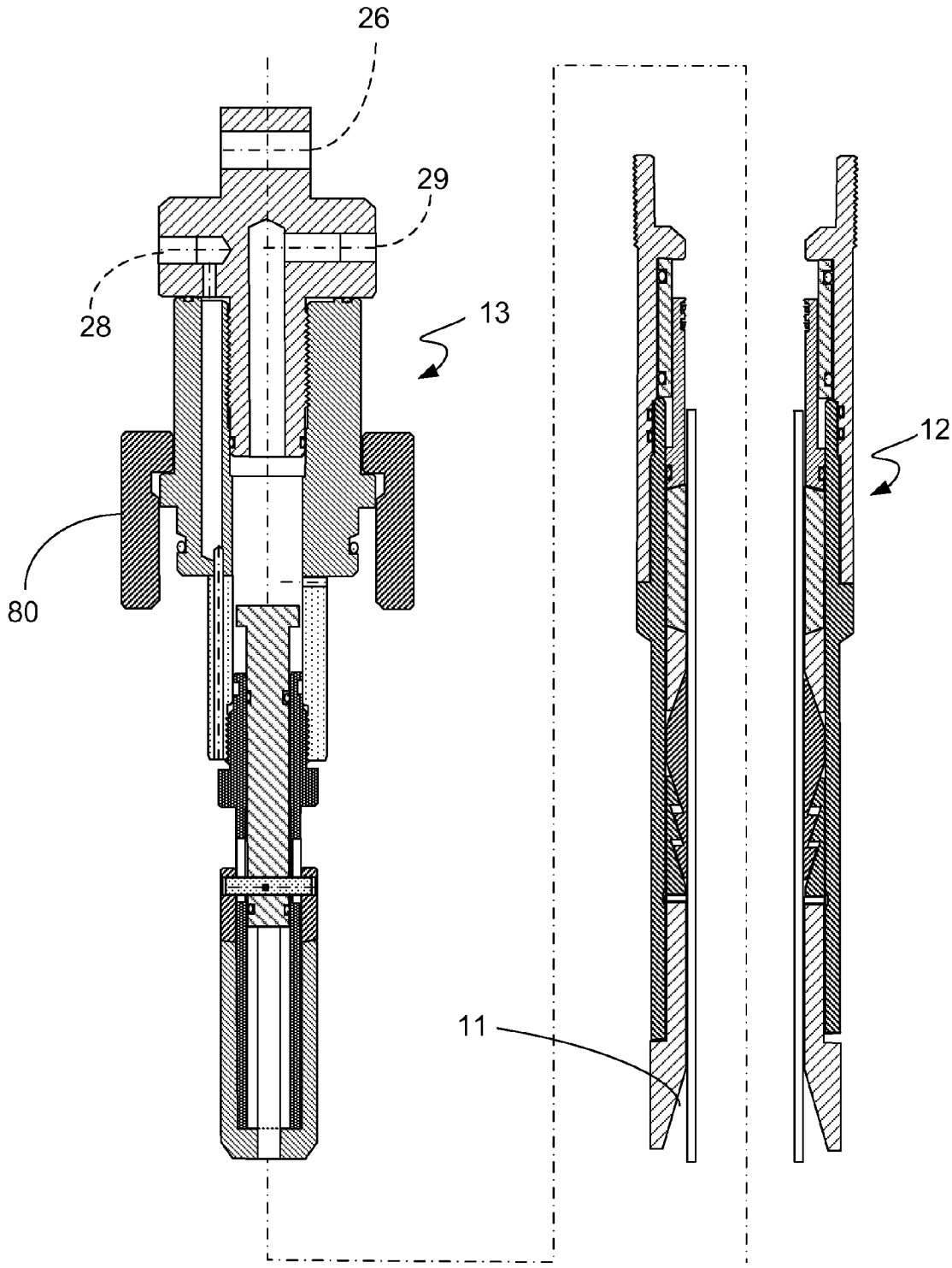
FIG. 5 is an exploded view of the hydraulic overshot apparatus with removable setting and testing core of the present invention with the setting and testing core removed from the lower portion remaining sealing engaged to the tubing.

During the setting motion, as illustrated in FIG. 3, when the setting piston 34 is moved to the down position, the split body lock ring 70 includes a plurality of teeth 72, also includes two o-rings 74 to hold it in place. As the setting piston 34 is forced down, the ring 70 travels down and locks all of the sealing elements in sealing position around the outer wall of tubing 11. At this point the both the test pressure and hydraulic setting pressure from fluid 27 can be released. After the packing elements are set, and the tubing slips 50 are set, the piston 34 was pushed down and locked everything around the tubing 11. After the pressures are released from above, the pressure is bled down to 2500 pounds with a needle valve. As seen in FIG. 5, next, the Bowen union nut 80, which is securing the removable setting and testing core portion 13 to the lower portion 12 of apparatus 10, is unscrewed and the removable setting and testing core portion 13 is pulled from the lower portion 12 of apparatus 10. The lower portion 12 remains sealing engaged around the wall of the upper part of tubing 11. The lower portion 12 secured to the tubing 11 is now ready to accommodate the various tools that can be placed on the upper end of the lower section 12, which includes a connection which allows the attachment of various devices, including but not limited to (1) Wireline Blowout Preventer Stack; (2) Work Over Blowout Preventer Stack; (3) Master Valve; (4) Temporary Well Control Stack; (5) Coil Tubing Blowout Prevent Stack and Injection Head; and (6) Device to pull tubing from the well.

The seals are established between the apparatus and the outer and inner walls of the tubing at approximately 2500 PSI. The actual pressure to create a seal is depended on the material properties of the seal element for both the inner and outer seals. Both the seals requires to bearing pressure between the outer and inner surfaces of the seal element. To insure a seal at pressure higher than the initial bearing pressures, the seal material must be stressed higher than the yield of the material to establish an extrusion seal.

In order to release the lower portion 12 of the apparatus 10, you need to move the lock mechanism/ring 22 back up, and then re-dress it. To release the ring 22, you use the releasing mechanism/nut 24. When nut 24 is unscrewed, the slips are released from the tubing and the lower portion 12 can be removed from the upper end of the tubing 11. The device has been designed to allow the tool to be removed from the tubing end. This is accomplished by unscrewing the Releasing Nut at the bottom of the tool. The releasing nut is designed to disengage the slip assembly and allow the relaxation of the packer elements to the original shape.

Figure 6:
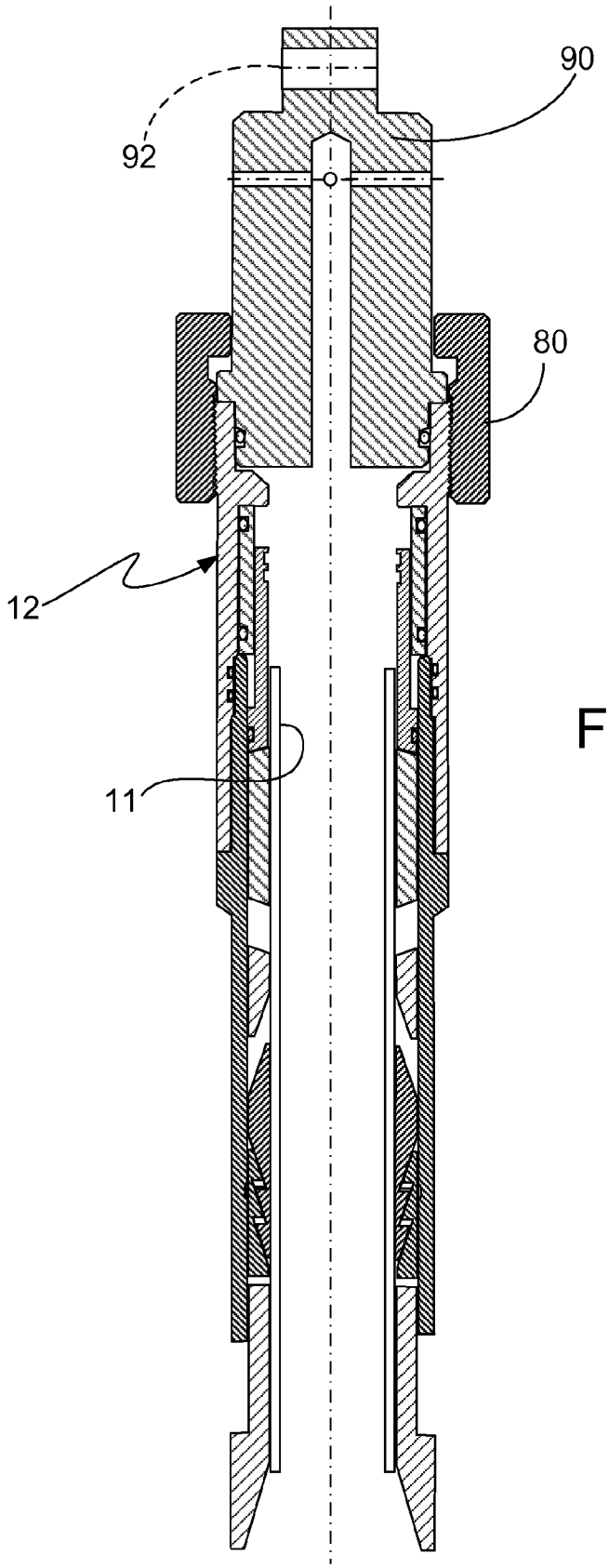
FIG. 6 is a cross-section view of the lower portion of the hydraulic overshot apparatus with removable setting and testing core of the present invention with an upper sub attached to remove the lower portion of the apparatus from the tubing after the lower portion has been released from the tubing.

After the lower portion 12 of the apparatus 10 is disengaged from the upper end 14 of the tubing 11, FIG. 6 illustrates a lifting sub 90 having an upper lifting eye 92 and a Bowen union nut attachment 80 on its lower end, which has been engaged to the upper end of the lower portion 12. The lower portion 12 is being lifted off of the tubing 11 so that the tubing can be moved to its next phase in the workover.

The following is a list of parts and materials suitable for use in the present invention.

PARTS LIST

| Part Number | Description |
|---|---|
| 10 | Hydraulic Overshot Apparatus |
| 11 | Tubing |
| 12 | First Lower Section |

-continued

PARTS LIST

| Part Number | Description |
|---|---|
| 13 | Setting and Testing Core Portion |
| 14 | Upper End |
| 16 | Packoff Mechanism |
| 18 | Slips |
| 20 | Packer Elements |
| 22 | Lock Mechanism/Ring |
| 24 | Release Mechanism/Nut |
| 26 | Lifting Eye |
| 27 | Fluid |
| 28 | Hydraulic Test Port |
| 29 | Hydraulic Setting Port |
| 30 | Center Chamber |
| 32 | Port |
| 34 | Setting Piston |
| 36 | Packer Elements |
| 37 | Flow Port |
| 39 | Release Nut |
| 44 | Cone |
| 50 | Tubing Slips |
| 60 | Test Piston |
| 64 | T-Bar |
| 66 | Tubing Test Elements |
| 68 | Upper Test Port |
| 69 | Lower Test Port |
| 70 | Split Body Lock Ring |
| 72 | Teeth |
| 74 | O-Rings |
| 80 | Bowen Union Nut |
| 90 | Lifting Sub |
| 92 | Lifting Eye |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A hydraulic overshot apparatus with a removable setting and testing core, comprising:

a. a first lower portion, attachable and positioned around an upper end of open tubing, under pressure;

b. a second upper portion, positioned in the first lower portion;

c. means for injecting fluid under pressure into the upper portion for sealingly engaging the first lower portion to an outer wall of the tubing and simultaneously sealing the upper portion to an inner wall of the tubing;

d. means for injecting a test fluid under pressure to test the integrity of seals between the apparatus and the outer wall and inner wall of the tubing; and e. a valving element for releasing the pressure between the upper portion and the inner wall of the tubing and removing the upper portion so that the lower portion remains sealing engaged to the wall of the tubing for attaching devices to conduct workover of the tubing under pressure.

2. The apparatus in claim 1 wherein the second upper portion comprises a removable setting and testing portion of the apparatus.

3. The apparatus in claim 1 wherein the apparatus is slidingly positioned onto the upper end of the open tubing.

4. The apparatus in claim 1, wherein there is further provided a first piston under fluid pressure to seal packing elements in the lower portion against the outer wall of the tubing.

5. The apparatus in claim 4, wherein there is further provided a second piston under fluid pressure to seal tubing packoff elements in the upper portion against the inner wall of the tubing.

6. The apparatus in claim 4, wherein the test fluid under pressure tests the integrity of the seal between the packing elements against the outer wall of the tubing.

7. The apparatus in claim 1, wherein the upper portion is removable from the lower portion after the fluid pressure is released, to allow other tools to be engaged to the sealed lower portion on the tubing.

8. A method of installing an overshot apparatus onto an open-ended length of tubing which has fluid pressure therein, comprising the following steps:

a. positioning the overshot apparatus onto the end of tubing;

b. injecting fluid under pressure into a first chamber of the apparatus to compress packing elements to seal around an outer surface of the tubing;

c. simultaneously, allowing the fluid in step b to compress tubing packoff elements around an interior wall of the tubing to seal the around the interior wall;

d. following steps b and c, injecting a test fluid to test the integrity of the seals established in steps b and c; and e. after establishing that the seal is proper, releasing the pressure from the interior tubing wall, so that an upper portion of the apparatus can be removed, while a lower portion remains sealed against the outer wall of the tubing to accommodate work on the tubing under pressure.

9. The method in claim 8, wherein seals are established between the apparatus and the outer and inner walls of the tubing at approximately 2500 PSI.

10. The method in claim 8, wherein the test fluid in step d is injected at a pressure of approximately 5000 PSI.

11. A hydraulic overshot apparatus with a removable setting and testing core, the apparatus comprising:

a. a first lower portion, positioned and attached around an upper end of open tubing having fluid pressure sealed off below;

b. a second removable setting and testing portion positioned in the first lower portion;

c. means for injecting fluid under pressure into the setting and testing portion for sealingly engaging the first lower portion to an outer wall of the tubing and simultaneously sealing the setting and testing portion to an inner wall of the tubing;

d. means for injecting a test fluid under pressure to test the integrity of the sealings between the apparatus and the outer wall and inner wall of the tubing; and e. a valving element for releasing the pressure between the upper portion and the inner wall of the tubing and removing the upper portion so that the lower portion remains sealing engaged to the wall of the tubing for attaching devices to conduct workover of the tubing under pressure.

12. The apparatus in claim 11, wherein the test fluid under pressure tests the integrity of the seal between the tubing packoff elements against the inner wall of the tubing.

* * * * *